US009598324B1

(12) United States Patent
McPherson

(10) Patent No.: US 9,598,324 B1
(45) Date of Patent: Mar. 21, 2017

(54) SOLID ELECTRICALLY CONTROLLED PROPELLANTS

(71) Applicant: Digital Solid State Propulsion, LLC, Reno, NV (US)

(72) Inventor: Michael D. McPherson, Reno, NV (US)

(73) Assignee: Digital Solid State Propulsion LLC, Reno, NV (US)

( * ) Notice: Subject to any disclaimer, the term of this patent is extended or adjusted under 35 U.S.C. 154(b) by 0 days.

(21) Appl. No.: 15/201,339

(22) Filed: Jul. 1, 2016

Related U.S. Application Data

(63) Continuation of application No. 14/011,677, filed on Aug. 27, 2013, now Pat. No. 9,382,168.

(60) Provisional application No. 61/693,381, filed on Aug. 27, 2012.

(51) Int. Cl.

| | |
|---|---|
| ***D03D 23/00*** | (2006.01) |
| ***D03D 43/00*** | (2006.01) |
| ***C06B 45/10*** | (2006.01) |
| ***C06B 25/34*** | (2006.01) |

(52) U.S. Cl.
CPC ..... *C06B 45/10* (2013.01); *C06B 25/34* (2013.01)

(58) Field of Classification Search
USPC ..... 149/3, 108.4, 108.6, 108.8, 109.2, 109.4
See application file for complete search history.

(56) References Cited

U.S. PATENT DOCUMENTS

| | | | | |
|---|---|---|---|---|
| 9,182,207 | B2 * | 11/2015 | McPherson | C06B 47/00 |
| 2011/0030859 | A1 * | 2/2011 | Sawka | C06B 21/0025 149/109.6 |
| 2012/0103479 | A1 * | 5/2012 | Katzakian | C06B 45/10 149/19.1 |
| 2013/0327455 | A1 * | 12/2013 | Katzakian | C06B 45/10 149/45 |

* cited by examiner

*Primary Examiner* — James McDonough
(74) *Attorney, Agent, or Firm* — Temmerman Law Office; Mathew J. Temmerman

(57) ABSTRACT

The present application discloses a variety of improvements that enhance at least one of the mechanical, chemical/energetic, ballistic, or adhesive properties, of a class of ECPs, regardless of whether said ECPs are in solid phase or gels, singly or in combinations thereof.

7 Claims, 7 Drawing Sheets

Shift from 165° to 175°C (329 to 347°F) Onset Temp, indicating improvement in thermal stability

DC Z-6020

DC Z-6032 bis(hydroxyalkyl) PDMS bis(3-aminopropyl) PDMS hydroxy-terminated PDMS

Properties of the main cyclodextrins

| Cyclodextrin | Mass | Outer diameter, (nm) | Cavity diameter (nm) | | Cavity volume, (ml./g) | Solubility, g/kg $H_2O$ [915] | Hydrate $H_2O$ [915] | |
|---|---|---|---|---|---|---|---|---|
| | | | Inner rim | Outer rim | | | cavity | external |
| α, $(glucose)_6$ | 972 | 1.52 | 0.45 | 0.53 | 0.10 | 129.5 | 2.0 | 4.4 |
| β, $(glucose)_7$ | 1134 | 1.66 | 0.60 | 0.65 | 0.14 | 18.4 | 6.0 | 3.6 |
| γ, $(glucose)_8$ | 1296 | 1.77 | 0.75 | 0.85 | 0.20 | 249.2 | 8.8 | 5.4 |

THEIC

Shift from 165° to 175°C (329 to 347°F) Onset Temp, indicating improvement in thermal stability Dequest 2090, BHMTPMPA, or Bis(hexamethylene)triaminopenta(methylene-phosphonic acid)

ADHP

SOLID ELECTRICALLY CONTROLLED PROPELLANTS

PRIORITY

This application is related to and is a continuation of nonprovisional patent application Ser. No. 14/011,677 filed Aug. 27, 2013, granted on Jul. 5, 2016 as U.S. Pat. No. 9,382,168 and which claims priority from the United States provisional application with Ser. No. 61/693,681, which was filed on Aug. 27, 2012. The disclosure of these applications are incorporated herein as if set out in full.

STATEMENT REGARDING FEDERALLY SPONSORED RESEARCH OR DEVELOPMENT

This invention was made with government support under W9113M10C0108 awarded by the Missile Defense Agency. The government has certain rights in the invention.

BACKGROUND

Field of the Invention

The present application is related in general to propellants, and in particular to a variety of improvements to previously disclosed electrically controlled propellants, wherein said propellants are solid, gel, or combinations thereof.

Background of the Invention

The assignee has disclosed several classes and specific examples of multiple Electrically Controlled Propellants in U.S. patent application Ser. Nos. 11/787,001, 12/467,209, 12/993,084, and the patents and patent applications incorporated therein, which are hereby incorporated by reference as if set out in full (hereinafter each such electrically controlled propellant may be referred to as an "Electrically Controlled Propellant" and collectively the "Electrically Controlled Propellants" or "ECP" or "ECPs"). While these Electrically Controlled Propellants provide many advantages over prior art propellants, such as but not limited to the ability to electrically control both ignition and extinguishing of the Electrically Controlled Propellants, as well as multiple controlled ignition/initiation and extinguishing cycles, these Electrically Controlled Propellants may be improved upon. Specifically the ECPs previously disclosed may be improved upon through the addition of various additives that improve one or more of the following: mechanical, chemical/energetic, ballistic, and adhesive properties of the ECPs.

It is thus a first object of the present application to present a variety of additives that enhance the mechanical properties of the ECPs.

It is a second object of the present application to present a variety of additives that enhance the ballistic properties of ECPs.

It is a third object of the present application to present a variety of additives that enhance the adhesive properties of ECPs.

It is a further object of the present application to present a variety of additives that enhance the chemical/energetic properties of the ECPs.

SUMMARY OF THE INVENTION

The present application discloses a variety of improvements that enhance at least one of the mechanical, chemical/energetic, ballistic, or adhesive properties, of a class of ECPs, regardless of whether said ECPs are in solid phase or gels, singly or in combinations thereof.

BRIEF DESCRIPTION OF THE FIGURES

The foregoing aspects and many of the attendant advantages of the invention will become more readily appreciated as the same becomes better understood by reference to the following detailed description, when taken in conjunction with the accompanying drawings, wherein.

DETAILED DESCRIPTION OF THE INVENTION

Figure 1:
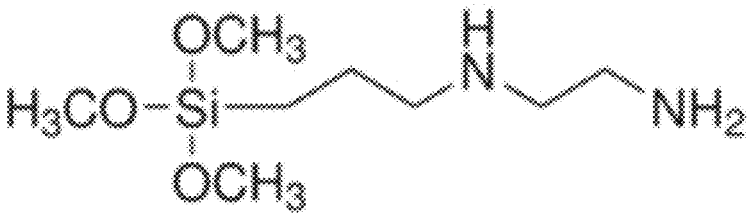
FIG. 1 shows the molecular structure of several organosilanes, siloxanes, and poly(dimethylsiloxane)s.
Figure 1:
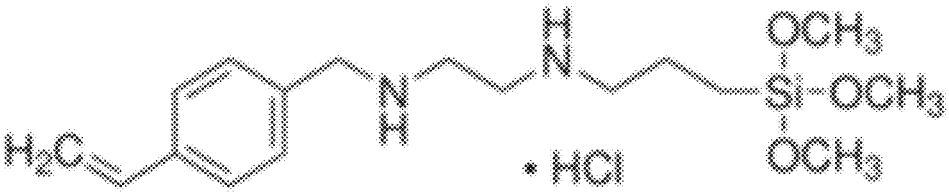
Figure 1:
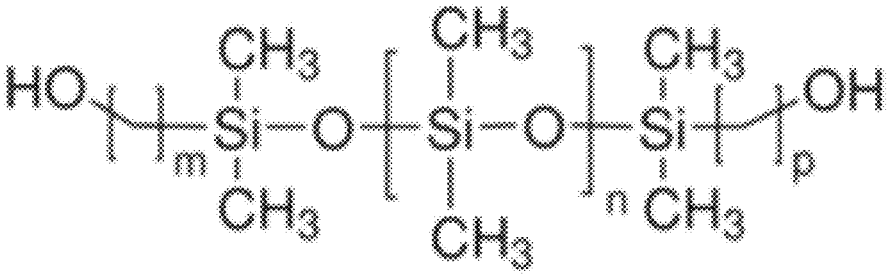
Figure 1:
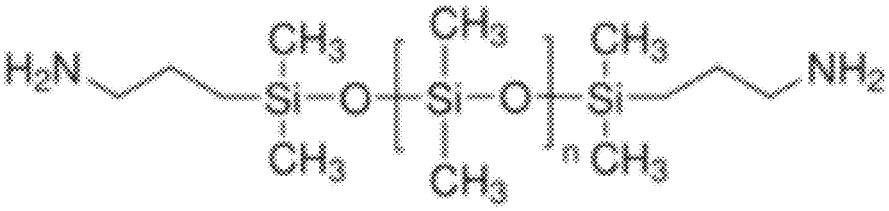
Figure 1:
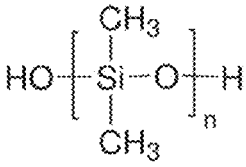

The following description is presented to enable a person of ordinary skill in the art to make and use various aspects and examples of the present invention. Descriptions of specific materials, techniques, and applications are provided only as examples. Various modifications to the examples described herein will be readily apparent to those of ordinary skill in the art, and the general principles defined herein may be applied to other examples and applications without departing from the spirit and scope of the invention. Thus, the present invention is not intended to be limited to the examples described and shown. All specific weight ranges of ECPs are considered for use with the present invention and the balance of fuel and oxidizer may be optimized as is known in the art to optimize the propulsive performance based on specific missions In a first embodiment, Boric Acid is provided in combination with the ECPs as a cross linking agent. By varying the amount of boric acid added, both the mechanical properties and the temperature range of the ECPs may be tailored as desired. Boric Acid may, in a preferred embodiment, be added to the ECPs at 0.01 to 5% by weight, preferably early in the formulation of the ECPs. Other ranges including a range above 5% by weight is described as an alternative embodiment of the invention. The addition of Boric Acid improves both the mechanical strength of the fully cured propellant, and also provides an additional benefit by altering the interim viscosity of the ECP formulations prior to final casting and curing, thus making the ECPs easier to work with. The addition of Boric Acid is highly beneficial and improves tensile strength and bulk modulus of the ECPs, particularly within the temperature range of −65 to +70 degrees Celsius. This increased tensile strength and bulk modulus is advantageous for solid Electrically Controlled Propellants. The improvement in strain values are observed by observation of an increase in strain value at maximum tensile stress above that typically seen in ECP formulations having no added boric acid. The improvement in Young's modulus (increase over baseline ECP formulations having no boric acid) is observed in uniaxial tensile specimens tested under conditions typical for these composite materials, using cast and cured 'dogbone' samples (JANNAF A/C specimen) prepared and tested according to the Joint Army Navy NASA Air Force (JANNAF) protocols, in the Chemical Propulsion Information Agency (CPIA) Publication 21, "Solid Propellant Mechanical Behavior Manual." In alternative embodiments either more or less Boric Acid may be added, in order to tailor specific properties of ECP as gel or solid. Addition of Boric Acid beneficially modifies the stress, strain, and bulk modulus of solid ECP compositions when tested using industry-standard uniaxial tensile specimens, upon examination of the stress vs. strain curves that result when the samples are tested at selected crosshead pull rates according to standard methods of test.

In a second embodiment, organosilanes, siloxanes, and poly(dimethylsiloxane)s may be added to the ECPs. All ECPs are seen to benefit to varying degrees based on composition, directly proportional to the type and level of particulate additives in the ECP formulation to which these compounds chemisorb; modification in process, processing sequence, concentration, method of addition, all provide the tailorability aspects for improvement in the characteristics of the ECPs. Exhaustive studies and perfection in application can never be achieved, however, several examples of these compounds are shown in FIG. 1. These compounds act as adhesion promoters, reduce moisture uptake, reduce hygroscopic characteristics of the ECPs, act as coupling agents in powdered fuel/binder additives, and act as inter-chain crosslinks when hydrolyzed with PVA polymer binder. Specific silane and siloxane functional groups may include amino, hydroxyl, and epoxy functional groups. Specific examples of these compounds include, but are not limited to, N-(2-Aminoethyl)-3-(trimethoxysilyl)propylamine Dow Corning® product Z-6020, N-[3-(Trimethoxysilyl)propyl]-N'-(4-vinylbenzyl)ethylenediamine (conveniently as the HCl salt, Dow Corning product Z-6032), poly(dimethylsiloxane)(PDMS), poly(dimethylsiloxane) bis(3-aminopropyl) terminated, and PDMS bis(hydroxyalkyl) terminated. Molecular structures for several of these additives are shown in FIG. 1.

Organosilanes, siloxanes, or poly(dimethylsiloxane)s may be added, in some embodiments, to an ECP formulation at 0.01 to 10% by weight, or used as substrate pretreatments. The substrate may be, without limitation, aluminum, phenolic composites, epoxy composites, stainless steels, polymeric films, synthetic rubber, natural rubber and elastomers. These are all substrates upon which the ECPs may be cast and then cured before use. In alternative embodiments more or less organosilanes, siloxanes, or poly(dimethylsiloxane)s may be added to the ECP formulation.

Organosilanes, siloxanes, and poly(dimethylsiloxane)s also reduce moisture uptake/reduce the hygroscopic characteristics of the ECPs, as well as increase storage stability by modifying the polar nature of the ECP to a less polar characteristic, thereby reducing water adsorption. Specifically, the addition of these compounds has been seen to reduce moisture uptake as evidenced by reduced weight gain via moisture uptake in high humidity storage environments. Samples with these additives in this class have been stored at ambient levels of relative humidity (up to 30% RH), and at elevated humidity levels (50 and 80% RH) with clear benefit provided by reduction of weight gain in these environments when samples of the ECP are stored at these conditions over time. These benefits are achieved when organosilanes, siloxanes, or poly(dimethylsiloxane)s are used as either formulation additives or as a surface coating. When used as a surface coating the organosilanes, siloxanes, or poly(dimethylsiloxane)s are coated onto the ECPs, as known in the industry, by precision cleaning of the ECP or substrate followed by brush or dip-coat application, then air or oven drying.

Organosilanes, siloxanes, and poly(dimethylsiloxane)s also act as coupling agents in powdered fuel/binder additives. In this aspect the organosilanes, siloxanes, or poly (dimethylsiloxane)s "couple" solid particles to the resin matrix, afford greater composite strength, viscosity, and/or toughness on cure of the ECPs. In the mode of coupling agents, these molecules can be selected to preferentially bind to both solid particulate additives, and upon completion of cure, also to the binding matrix, affording increased strength and improved performance of solid ECP.

Organosilanes, siloxanes, and poly(dimethylsiloxane)s also act as inter-chain crosslinks when hydrolyzed with a PVA polymer binder. As discussed in the above patent applications incorporated herein by reference, the ECPs may comprise a PVA polymer binder, employed to transform a slurry, semi-liquid, pourable and castable non-solid non-gel ECP into a solid or gel form, which is useful as a propellant. In this application, the organosilanes, siloxanes, or poly (dimethylsiloxane)s crosslink or chain-extend the PVA polymer, thus modifying the ultimate flexibility, hardness, and toughness of the cured solid ECP, and alternatively modify the rheology and flow characteristics of gel ECP. In one embodiment these are added at up to 5 percent by weight and in other embodiments these are added at beyond 5 percent by weight. Preferably, they are added at up to five percent by weight because beyond that tends to dilute the ECP performance benefits. Improvements are seen as increased stress values in uniaxial tensile tests along with beneficial increase in bulk modulus without significantly decreasing strain, when the inter-chain crosslinks are optimized by selection of the type and level of the silanes or siloxanes. Gel form ECPs are beneficially modified by the inclusion of Organosilanes, siloxanes, and poly(dimethylsiloxane)s to specifically adjust yield stress and shear thinning behavior to perform optimally in systems having separate propellant tanks and combustion chambers, wherein tailorable transport properties are important and allow the ECPs to perform well in a wide variety of propulsion missions.

Figure 2:
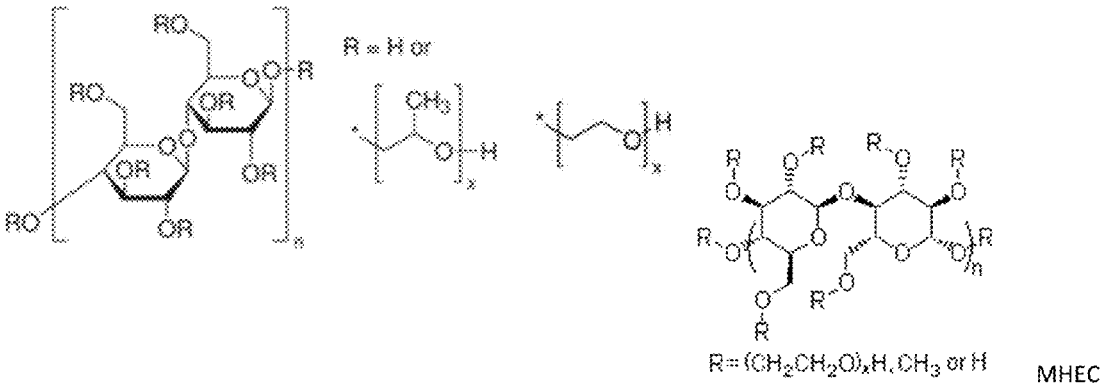
FIG. 2 shows the molecular structure of several polyhydroxyl compounds.

In a third embodiment, polyhydroxyl compounds, such as cellulose compounds with hydroxyethyl-, hydroxypropyl-, methyl hydroxyethyl- and related substitutions, and cellulosic esters, such as methyl hydroxyethyl cellulose (MHEC) may be added to the ECPs. By selectively adjusting the type and level of these additives, viscosity of uncured compositions retain sufficient resistance for settling of high energy dense additives, yet allow sufficient flow for the uncured compositions to fill highly complex mold cavities. Further, these additives (type and level by weight percent) will disallow undesired settling of these dense high performance additives while the uncured formulation is achieving cure to desired strength and stiffness over time. Molecular structures for several of these compounds are shown in FIG. 2. This third embodiment provides benefits such as adjustment of viscosity and flow characteristics, increased binder capability to hold particulate fuel ingredients without separation or classification, while in process to create the cured solid propellant, and are selected to tailor the manufacturing processability for wide varieties of applications. The benefit of selection of these classes of compounds, singly or in combination with a PVA polymer, allows the adjustment of transport properties such as yield stress or shear dependent viscosity in applications as gels.

Figure 3:
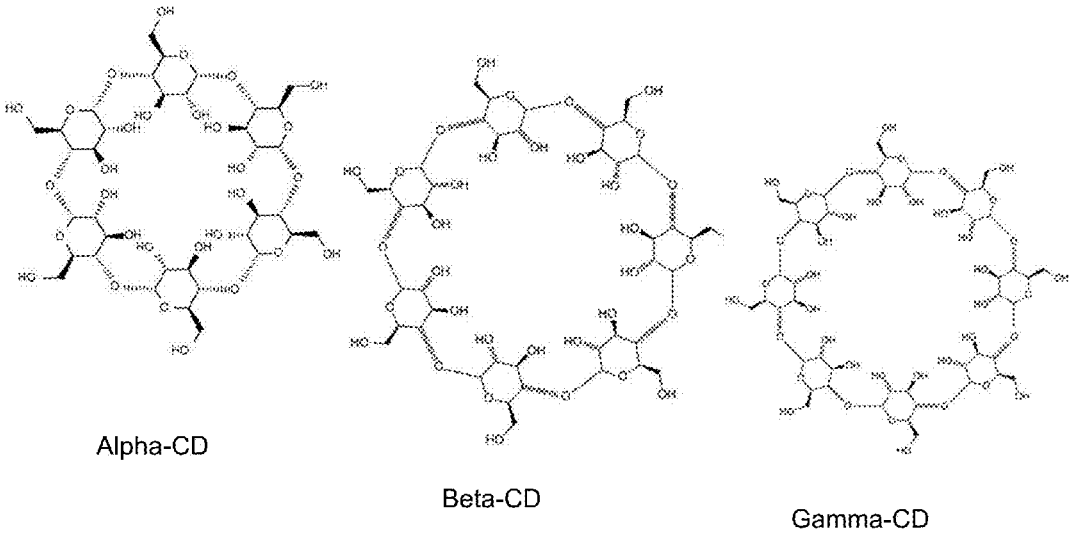
FIG. 3 shows the molecular structure of several acyclic or cyclic saccharides (cyclodextrins) as well as a table of properties of several main cyclodextrins.
Figure 3:
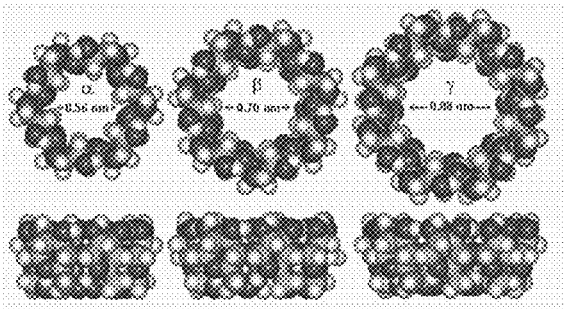

In a fourth embodiment, cyclic saccharides (cyclodextrins) and acyclic saccharides (complex sugars or polysaccharides) may be added to the ECPs, or their precursors. Molecular structures of several examples of such cyclodextrins and acyclic saccharides are shown in FIG. 3. These compounds are highly soluble in the ECP/HAN oxidizer matrix and provide increased stability and storage life. Additionally, these compounds are also able to sequester undesirable contaminants, such as transition metal ions, which may destabilize the ECPs result in off-gassing, premature decomposition, and increased hazard characteristics such as sensitivity of the ECP to impact or friction. The addition of cyclic saccharides beneficially increases the onset temperature of exothermic propellant reaction. The cyclic saccharides may be α, β, or γ-cyclodextrin, with or without substituents, which add to mechanical or ballistic performance of the ECPs.

As shown in FIG. 3, it is the 3D structure of these cyclic saccharides (cyclodextrins) that provides the ability to sequester/retain transition metal contaminants that can destabilize the ECP propellants. It is the 3D structure that also provides the benefits of improved ballistic, mechanical, and conductive properties, as well as greater ignitability/ignition response. The 3D structure of these cyclic saccharides (cyclodextrins) provides the benefit of retaining and isolating more energetic compounds within the cavity of the cyclic structure, causing the overall ECP formulation to have lesser hazard properties, yet improved specific impulse for propulsion applications. Examples of energetic compounds that may be isolated within the 3D structure of cyclic saccharides may include but not be limited ammonium dinitrimide (ADN) or hydrazinium nitroformate (HNF), both of which have detonation type properties that are minimized by sequestration in the cyclic saccharide cavity when in ECP formulations.

The 3D structure of the cyclic saccharides (cyclodextrins) also provides a pathway to introduce nonpolar energetic compounds into the generally polar ECP formulations. Such nonpolar compounds may comprise, with limitation, nitroglycerine, nitrate ester energetic liquids, RDX or HMX, solid nitramines, and reduced solubility organonitrates, such as nitromethane.

Preferably, the cyclic saccharides (cyclodextrins) are added to the ECPs at up to approximately 20% by weight. In alternative embodiments more than 20% by weight may be employed.

Additionally, complex or polysaccharides, such as but not limited to xylose, sorbitol, amylose, amylopectin, and including the cyclodextrins, and plant-based starches may be added to the ECPs. When added at less than approximately 5% weight, these compounds impart burning rates from 1 to 10 ips (inches per second) at 1000 psi while remaining highly soluble in ECP/HAN. These compounds, when formulated to selectively adjust the characteristic of burning rate versus pressure, the conventional burning rate law of St Robert is compared in tests with formulations with or without these additives; the resulting adjustment of burning rates by their addition allows specific formulation development for diverse missions of rocket motor applications.

Figure 4:
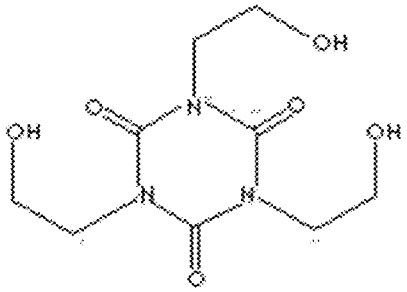
FIG. 4 shows the molecular structure of THEIC and a plot of onset temperature shifts due to the addition of THEIC to an Electrically Controlled Propellant.
Figure 4:
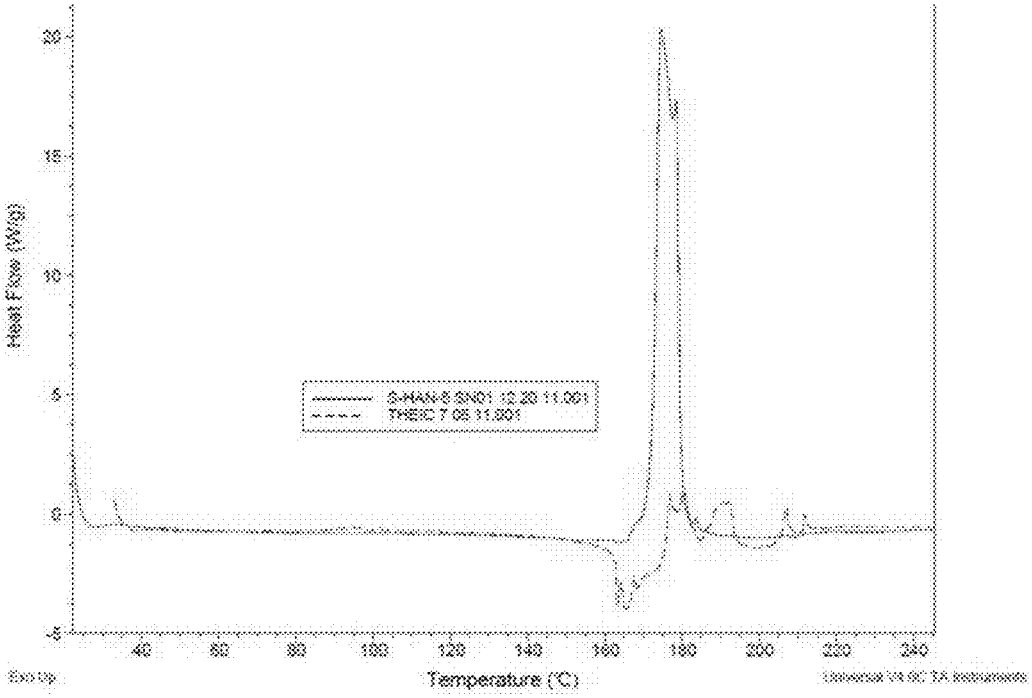
Figure 5:
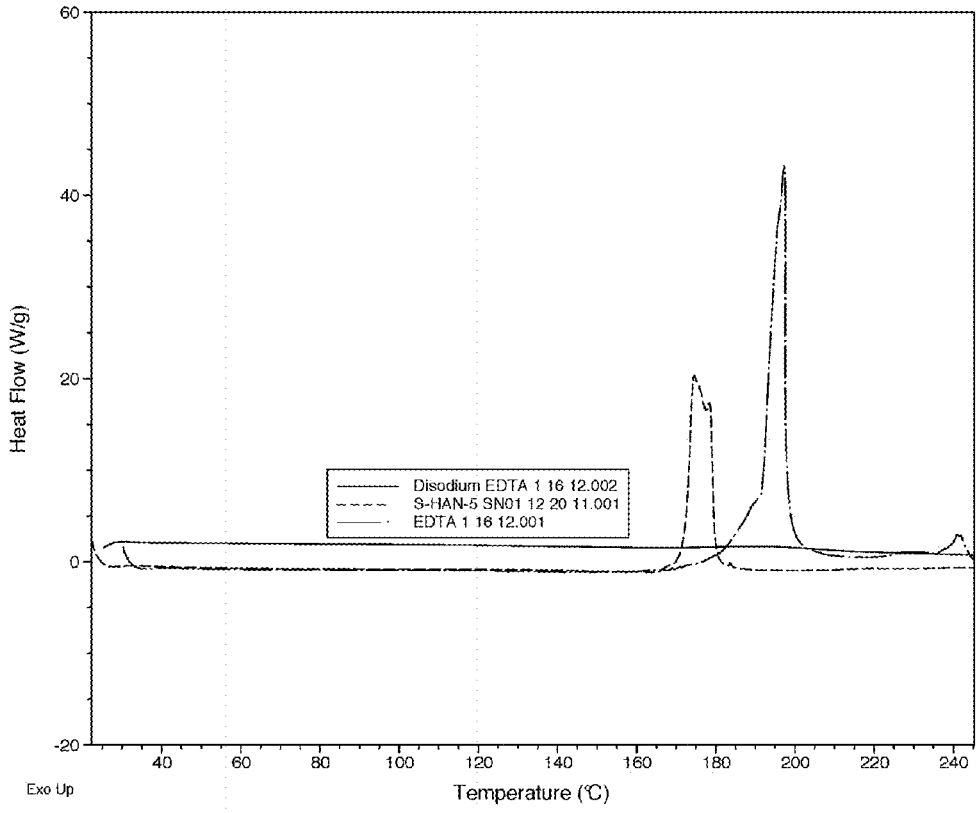
FIG. 5 shows a plot of onset temperature shifts due to the addition of EDTA and disodium EDTA to an Electrically Controlled Propellant.

In a fifth embodiment multifunctional amines, such as but not limited to THEIC, syn trishydroxyethylisocyanurate, and ethylenediaminetetraacetic acid (EDTA) may be added to the ECPs to improve stability, beneficially shift onset temperature ranges (via DSC) to higher values, and sequester catalytic decomposers and transition metals. The molecular structure of THEIC and plots of onset temperature shifts from 165 deg. C. to 175 deg. C. (THEIC) and 170 deg. C. to 180 deg. C. (EDTA) and 235 deg. C. (disodium EDTA) are shown in FIGS. 4 and 5. Preferably these compounds are added at approximately 0.01 to 5% weight, but may be added in greater or lesser quantities.

Figure 6:
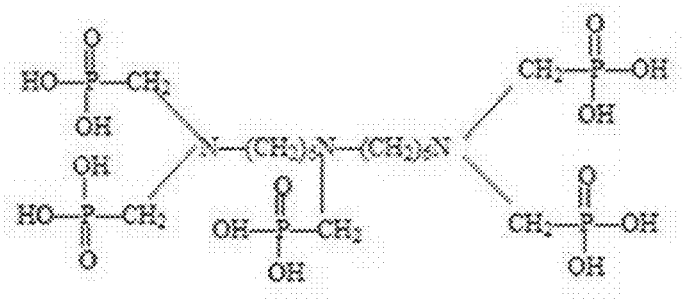
FIG. 6 shows the molecular structure of Dequest 2090 (Bis(hexamethylene triamine penta(methylemephosphonic acid))
Figure 6:
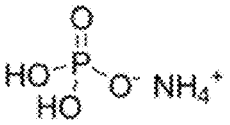

In a sixth embodiment, one or more different phosphates, such as but not limited to multifunctional phosphates, organophosphates, polyphosphates, and phosphonates may be added to the ECPs. It is found that these compounds protect the oxide layer of preferred metal powders, such as aluminum, enhancing the long-term storage of formulations that employ specific type and kind, and weight percent level of this class of compounds, to maximize the protective characteristics to the metal additive oxide shell. These compounds are effective as buffers and stabilizers for metalized electrical plastisol propellants made at DSSP, particularly aluminized electrical plastisol propellants as a subclass, reducing the deterioration of the aluminum oxide coating and hence decomposition of the base metal and evolution of offgas products which reduce storability and age-life. A particular example of such a compound is the commercially available Dequest 2090 (Bis(hexamethylene)triaminopenta (methylene-phosphonic acid), singly or in combination with ammonium dihydrogen phosphate (ADHP) the molecular structures of which is shown in FIG. 6. Phosphato-substituted buffers and stabilizers are effective when, in a preferred embodiment, are added to the ECPs at 0.01 to 5% by weight, providing sufficient benefit at this level without significant dilution of performance.

Figure 7:
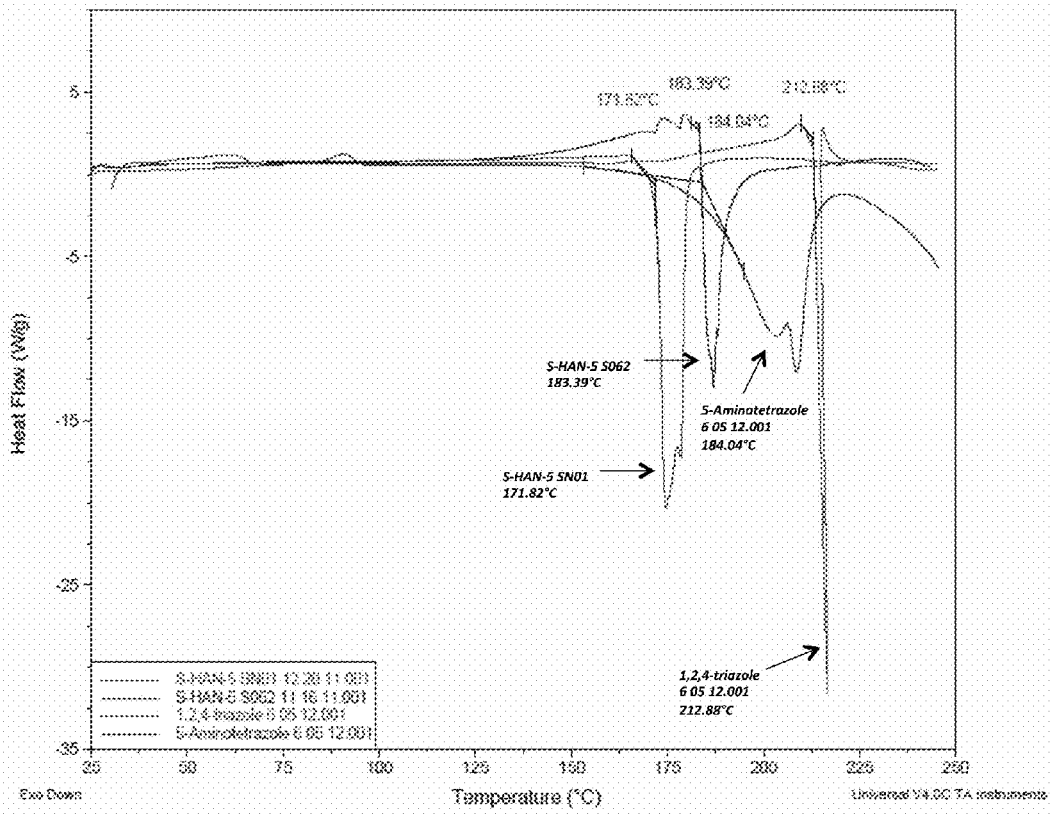
FIG. 7 shows a plot of onset temperature shifts due to the addition 1,2,4-triazole and 5-Aminotetrazole to an Electrically Controlled Propellant.

In a seventh embodiment, polynitrogen compounds, such as but not limited to 1,2,4-triazole, may be added to the ECPs to increase the stability and onset temperatures of the ECPs. The addition of 1,2,4-triazole has been observed to shift onset temperature from 172 deg. C. to 213 degrees Celsius. A plot of the onset temperature shift due to the addition of 1,2,4-triazole is shown in FIG. 7. Preferably the polynitrogen compounds are added at 0.01 to 5% weight, but may be added or greater or lesser quantities. Polynitrogen-heterocycles and high nitrogen containing compounds are effective when optimized, providing sufficient benefit at this level without dilution of performance.

Another polynitrogen compound, 1,3,5-triazine (melamine) may be added to the ECPs to act as a ballistic modifier and to improve mechanical properties of the ECPs. This compound provides the benefit of slope reduction, wherein slope is part of the mathematical relationship of burning rate versus pressure, described in textbooks in the "burning rate model of de Saint Robert." When 1,3,5-triazine (melamine) is used, the optimized benefit is realized when added in the range of 0.1 to 5% weight, both in terms of improved mechanical integrity across a wide temperature range (for example from −65 to +70° C.) in solid ECPs, and allowing successful deployment in propulsion missions. Additionally, to selectively tailor the ballistic properties according to the model of de Saint Robert, the amount of melamine may be chosen to beneficially adjust the ballistics to optimally perform the propulsion duty assigned. Said again, it is of benefit in many embodiments of ECPs to adjust the characteristic burning rate slope, for which additives may be chosen, to tailor this characteristic. Polynitrogen-heterocycles and high nitrogen containing compounds are effective when optimized, providing sufficient benefit at this level without dilution of performance.

By use of additives in ECP formulations, nonmetallic in the case of melamine, or in general as metal oxides of titanium, silicon, aluminum, not specifically limited by element or concentration, characteristic slope is tailored to beneficially perform in ECP formulations. Specifically, slope reduction may be seen when the melamine additive is at low levels (<5% weight). Specific metal oxide additives may include, but are not limited to $TiO_2$, $SiO_2$, and Al2O3, when finely divided and well blended into the electrical propellant formulations. Additional benefit of slope reduction (reduction of the burning rate exponent and not significantly increasing burning rates across the pressure range of interest for propellants typically from 1 atm to 200 atm chamber pressures) is seen when these selected oxides are formulated as nanophase ingredients (average particle size less than 100 nanometers), however, restriction to this size alone to see the characteristic slope adjustment benefit is not required.

In an eighth embodiment, nanoengineered fuel additives (particulate modifiers) may be added to the ECPs to achieve very high burning rates. Such compounds may comprise Al, B, Si, or Ti. Preferably these fuel compounds are added in stoichiometric ratios with the ECPs' oxidizers in appropriate balance for optimum performance. With these fuel additives, the ECPs combust at greater than 1 ips to 10 ips or faster, while exponents are controlled to less than 0.8. Generally, the additives have an approximate diameter of 100 nanometers or less to realize optimum benefit.

The ECPs may be used with polymeric embedment granules/embedment liners, particularly but not limited to PVA granules. These granules/embedment liners help bond the ECPs to a wide variety of substrates such as rocket motor cases with insulation. This is accomplished by providing high surface area granules that swell and infiltrate at the ECP/motor case interface, providing tough elastomeric adhesion to the substrate. In a preferred embodiment, PVA granules may be greater than 1-2 mm in diameter, or in alternative embodiments, smaller than 1 mm. The choice of embedment granule size is determined by the size of the rocket motor and desired bond characteristics. The PVA granules may be separately bonded to the substrate using an adhesive before the ECP is introduced to the substrate and subsequently cured.

The ECPs may be formulated with alternating layers of high and low burning rate regions for propulsion control with digital electrical techniques. These alternating layers can result in easier, faster repeated ignition and extinguish cycles. These layers may be selected from less than approximately tenths of an inch up to the entire dimension of the propellant grain, in varying geometries specifically chosen to meet propulsion missions having the highest performance.

Various suitable ignition electrodes as is known in the art may control the ECPs. These electrodes may be, without limitation, foams, rods, wires, fibers, conductively coated particles, mesh structures, conductively treated surfaces, or woven structures.

With respect to the above description, it is to be realized that material disclosed in the applicant's drawings and description may be modified in certain ways while still producing the same result claimed by the applicant. Such variations are deemed readily apparent and obvious to one skilled in the art, and all equivalent relationships to those illustrated in the drawings and equations and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact disclosure shown and described, and accordingly, all suitable modifications and equivalents may be resorted to, falling within the scope of the invention.

I claim:

1. An improved electrically controlled propellant wherein:

a. The electrically controlled propellant comprises boric acid; and b. tetrazole without functional group substitutions.

2. The improved electrically controlled propellant of claim 1 wherein:

a. said boric acid is alters the interim viscosity of the electrically controlled propellant.

3. The improved electrically controlled propellant of claim 2 wherein:

a. said electrically controlled propellant comprises approximately 0.01 to 5% by weight boric acid.

4. The improved electrically controlled propellant of claim 1 wherein:

a. said electrically controlled propellant comprises approximately 0.01 to 5% by weight boric acid.

5. The improved electrically controlled propellant of claim 1 wherein:

a. said electrically controlled propellant comprises more than 0.001% by weight boric acid.

6. The improved electrically controlled propellant of claim 1 wherein:

a. said boric acid improves cross-linking and increases the mechanical strength of the electrically controlled propellant.

7. An improved electrically controlled propellant wherein:

a. the electrically controlled propellant comprises boric acid; and b. at least one nitrogen heterocycle in the class of azoles: imidazole, pyrazole, 1,2,3-triazole, without various functional group substitutions on the class structures.

* * * * *